US007451879B2

(12) United States Patent
Ford et al.

(10) Patent No.: US 7,451,879 B2
(45) Date of Patent: Nov. 18, 2008

(54) CONVERTIBLE PACKAGE FOR MERCHANDISING A WALLET AND FOR FORMING A PERSONAL ITEM CADDY OR VALET

(75) Inventors: Jonathan Ford, Melrose Park, PA (US); Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 724 days.

(21) Appl. No.: 11/172,565

(22) Filed: Jun. 27, 2005

(65) Prior Publication Data

US 2006/0289336 A1 Dec. 28, 2006

(51) Int. Cl.
*B65D 75/00* (2006.01)

(52) U.S. Cl. ..... 206/779; 206/461; 206/806; 206/818

(58) Field of Classification Search ..... 206/45.2, 206/45.21, 38, 779, 461, 478, 756, 758, 765, 206/806, 818
See application file for complete search history.

(56) References Cited

U.S. PATENT DOCUMENTS 3,480,138 A * 11/1969 Baker ..... 206/461
3,994,460 A 11/1976 Geiger
4,043,450 A * 8/1977 Rielly ..... 206/761
5,322,159 A * 6/1994 Houlihan ..... 206/45.2
5,772,039 A 6/1998 Orr et al.
6,053,326 A 4/2000 Ford

* cited by examiner

*Primary Examiner*—David T. Fidei
(74) *Attorney, Agent, or Firm*—Caesar, Rivise, Bernstein, Cohen & Pokotilow, Ltd.

(57) ABSTRACT

A convertible display package and a wallet arranged to be hung from a support. The package includes a tray and a housing. The tray has a base wall, a peripheral side wall, an open top and a hollow interior. The wallet is located within the tray's interior. The housing is similarly constructed, except that its side wall includes a gap. The tray is arranged to be located within the housing, with its sidewall adjacent the housing's sidewall and with its open top within the housing's open top so that the wallet is visible. The tray is arranged to be slid out of the housing through the gap. A pair of magnets are provided for releasably holding the tray within the housing. The housing can be reversibly disposed with respect to the tray to form a lid with the base wall of the housing closing the open top of the tray.

14 Claims, 2 Drawing Sheets

CONVERTIBLE PACKAGE FOR MERCHANDISING A WALLET AND FOR FORMING A PERSONAL ITEM CADDY OR VALET

BACKGROUND OF THE INVENTION

1. Field of Invention

This invention relates to packages for merchandising items and, more particularly, to a convertible package for holding a wallet, bill-fold or the like on a rack or other support structure for display and merchandising, and which package can be converted to be used thereafter as a caddy or valet box for small personal items, e.g., jewelry.

2. Description of Related Art

The merchandising of wallets, billfolds and the like is commonly effected by displaying those items on a display rack or suspended from horizontally projecting members, e.g., prongs or hooks.

In U.S. Pat. No. 5,772,039 (Orr et al.) there is disclosed a packaging system for displaying an article, such as a wallet, in a manner such that the it is readily accessible to shoppers, but are relatively difficult to shoplift. The packaging system comprises three main elements: a box, a box insert, and an attachment mechanism which secures the wallet to the box insert. The box insert is then adhesively attached to the box.

In U.S. Pat. No. 6,053,326 (Ford), which is assigned to the same assignee as the subject invention, there is disclosed another packaging system for a wallet or billfold to enable it to be opened and examined, while deterring its removal from the packaging system. The packaging system basically comprises a box and a band member formed of a tear resistant material, e.g., a flat strip of plastic, which extends through a portion of the wallet and is secured to the box. A lid is provided to cover the box. A flanged insert member may also be provided in the interior of the box to serve as a means for carrying visible indicia, e.g., the model designation of the wallet or billfold, a trademark, pricing information, etc.

Other patents disclose devices for merchandising wallets. For example, U.S. Pat. No. 3,994,460 (Geiger) discloses a one-piece decorative display stand intended for use in displaying a variety of alternative types of merchandise items such as billfolds or the like in any number of generally vertically upstanding positions such that the item displayed is presented in an attractive manner to consumers. The display stand is generally comprised of a molded body which has a plurality of grooves for receiving billfolds, wallets or the like and for supporting them in a generally vertical position.

While the packages of the aforementioned prior patents appear generally suitable for their intended purposes, they still leave something to be desired from one or more of the standpoints of the utility of the packaging after the product has been purchased and the ability of the package to be suspended from a prong or other hanger of a conventional display rack or otherwise held vertically.

BRIEF SUMMARY OF THE INVENTION

A display package for an article, e.g., a wallet. The package is arranged to be hung from a support structure, e.g., a prong of a display rack, and comprises a tray and a housing. The tray is a box-like member having a base wall, a side wall extending about the periphery of the base wall, an open top and a hollow interior defined between the base wall and the side wall and in communication with the open top. The hollow interior of the tray is arranged for receipt of the article therein. The housing has a base wall, a side wall extending about a portion of the periphery of the base wall of the housing, an open top and a hollow interior defined between the base wall of the housing and the side wall of the housing and in communication with the open top of the housing. The side wall of the housing has a gap therein in communication with the hollow interior and the open top of the housing.

The tray is arranged to be located within the hollow interior of the housing, with the side wall of the tray being located adjacent the side wall of the housing and with the open top of the tray being located within the open top of the housing so that the article is visible therethrough.

The tray is also arranged to be slid out of the housing through the gap. A magnetic closure assembly is provided in the package for releasably holding the tray within the hollow interior of the housing.

The housing is adapted to be reversibly disposable with respect to the tray to form a lid for the tray, with the tray located within the hollow interior of the housing and with the base wall of the housing closing the open top of the tray, whereupon the hollow interior of the tray is totally enclosed.

In accordance with one preferred aspect of the invention the package includes a hanger releasably secured, e.g., adhesively releasably secured, to the housing to enable the package to be suspended or hung from a prong or other support member.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
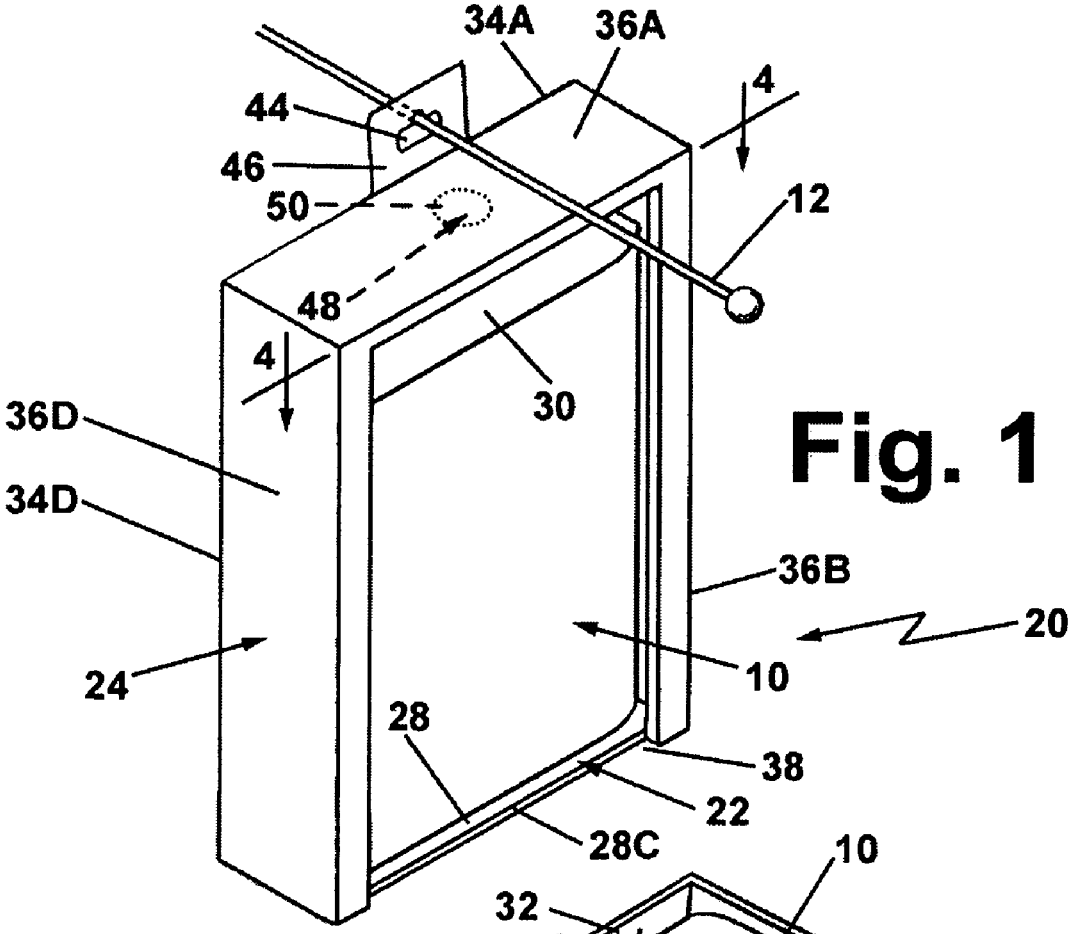
FIG. 1 is an isometric view of one exemplary embodiment of convertible package of the subject invention shown holding a wallet therein and being suspended from a hook or prong of a conventional merchandising display rack or support.

Referring now in greater detail to the various figures of the drawing, wherein like reference characters refer to like parts, one exemplary convertible package 20 constructed in accordance with this invention. The package 20 is initially configured as a display box to display a wallet 10, bill fold or the like so that it can be seen and examined by potential purchasers, but is convertible thereafter to serve as a valet or caddy for small personal items.

The package basically comprises a tray 22 and a housing 24. The housing is arranged so that when it is oriented in one manner it serves as receptacle for the tray and when reversed into another orientation, i.e., inverted, it serves as a cover or lid for the tray. To that end the tray is arranged to be initially nested or disposed within the housing 24 to form an open box-like assembly holding the wallet so that the wallet can be readily viewed and examined in a retail environment. After the package 20 with the wallet 10 therein has been purchased and brought home by the buyer, the wallet 10 can be readily removed for use. Unlike the wallet-holding boxes of the prior art as discussed above, which after the wallet has been removed are discarded, the package 20 of this invention is suitable for continued, albeit other, usage. In particular, after serving as the vending box for the wallet, the package 20 can be converted to be used as a valet, caddy or case for small personal items, e.g., jewelry, etc. In fact, if desired, it can still be used to hold the wallet when the wallet is not being used by the purchaser.

By virtue of its ability for dual usage, the convertible package of this invention can serve as a gift or premium to the purchaser of the wallet, by offering that purchaser additional value for his/her purchase of the wallet. Moreover, as will be appreciated from the discussion to follow the package 20 of this invention offers significant advantages to the manufacturer/retailer since it can be made for a small incremental cost over the cost of a disposable package, like the prior art, yet still provide an aesthetically pleasing and "rich-looking" appearance, thereby enhancing the prospect of selling the wallet.

The details of the tray will be described later. Suffice it for now to state that the tray 22 is of an open box-like configuration that includes a hollow interior which serves as the receptacle for initially holding the wallet 10. The tray 22 is located within the housing 24 and is slidable with respect thereto. Thus, the tray 22 can be slid out of the housing 24 to enable the prospective purchaser to more closely examine the wallet 10. The convertible package includes a magnetic assembly, to be described in detail later, to deter the accidental sliding of the tray out of the housing, particularly if the package 20 is oriented so that the force of gravity could cause the tray to drop out of the housing. This feature is of considerable importance when the package is in the retail environment to prevent the tray (with the wallet therein) from falling out of housing if the package is suspended from a hook or prong of a conventional display rack or if a potential buyer lifts the entire package off of its display rack or counter to examine it and holds it vertically.

When the package is no longer needed as a display box, e.g., after the package with the wallet has been purchased and brought home, the wallet can be removed and the package can be readily converted into a valet or caddy, wherein the hollow interior of the tray can be used for holding any other small item(s) to be stored. In particular, the housing can be inverted with respect to the tray from the orientation shown in FIGS. 1 and 2 to enable it to serve as a lid for the tray. To that end the inverted housing can be slid over to the tray to close off the interior of the tray as shown in FIG. 3.

Figure 2:
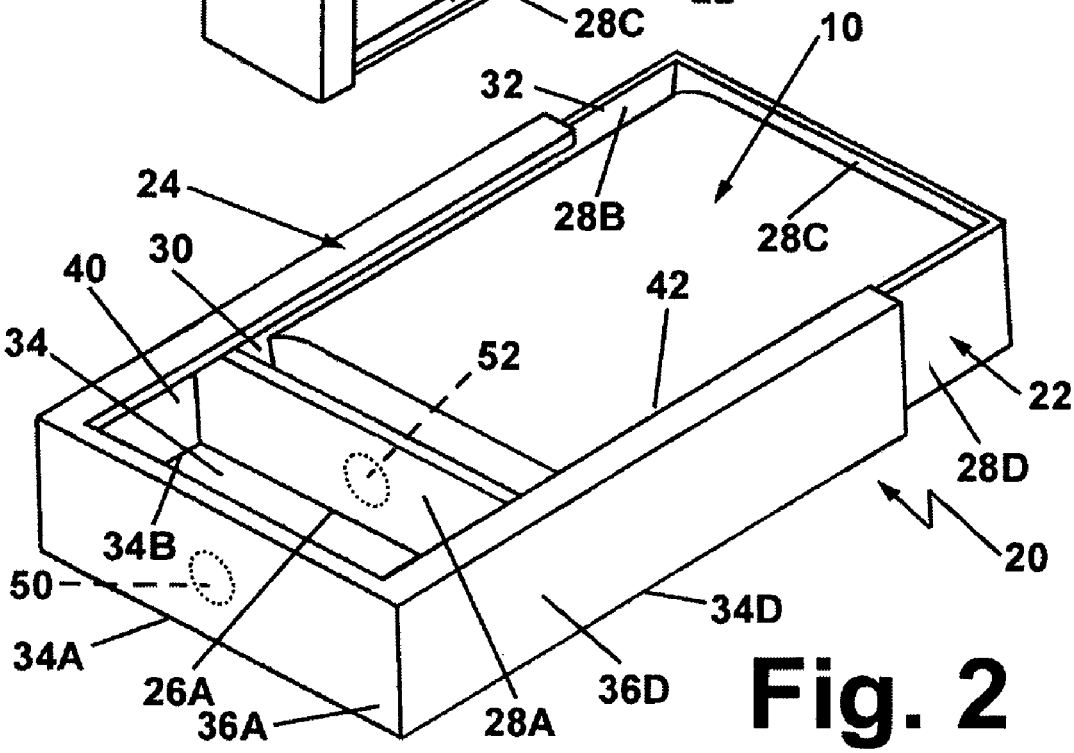
FIG. 2 is an isometric view showing the package of FIG. 1 in the process of being opened.
Figure 3:
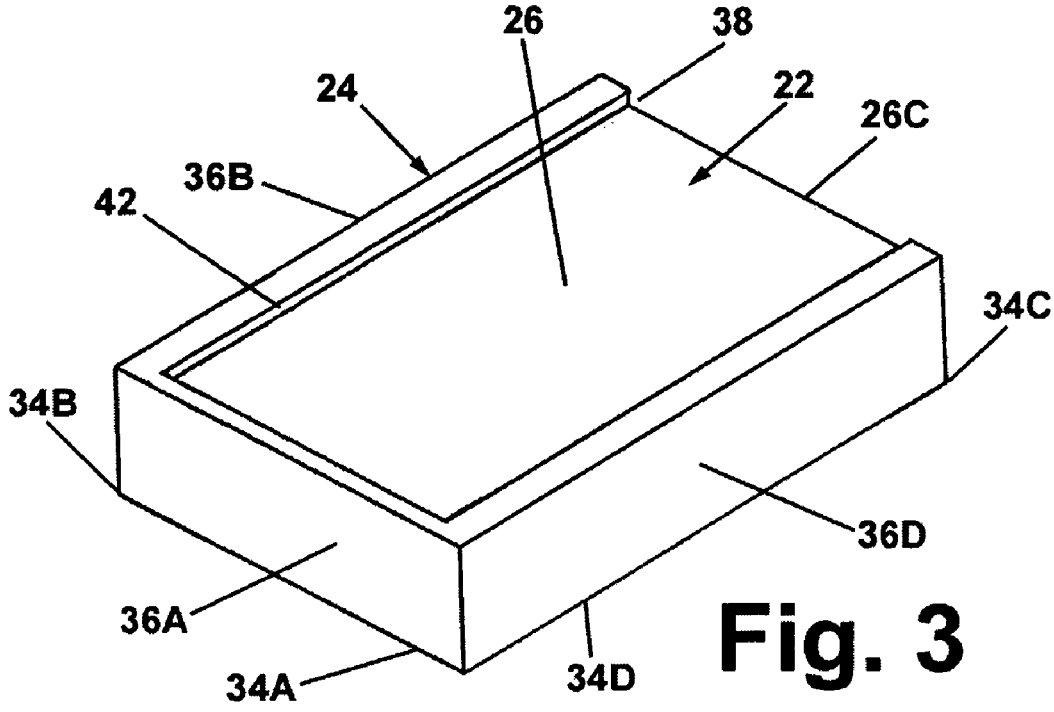
FIG. 3 is an isometric view, similar to FIG. 2, but showing the package after it has been converted into a personal item caddy or valet and shown in its closed or sealed configuration.
Figure 4:
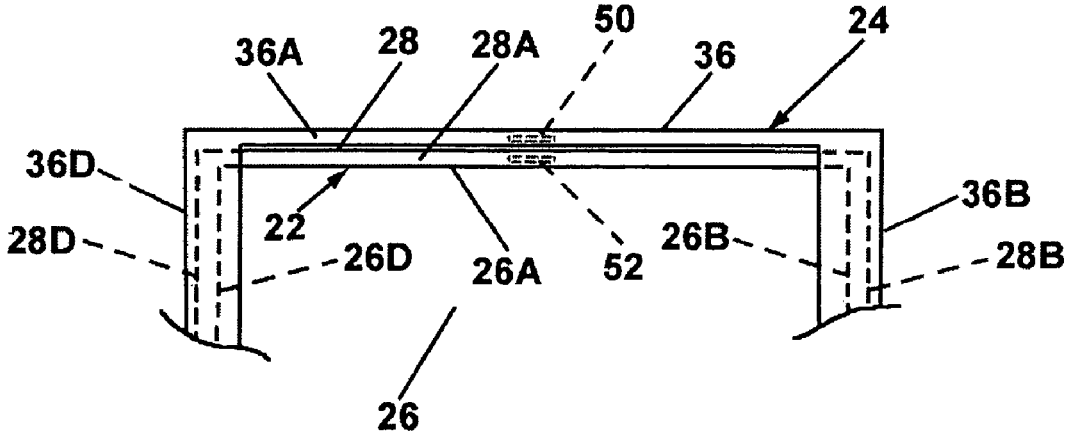
FIG. 4 is a slightly enlarged sectional view taken along line 4-4 of FIG. 1.

Referring now to FIGS. 1, 2 and 4 the details of the package will now be described. As can be seen the tray 22 basically comprises a box-like construction having a generally planar base wall 26 (FIG. 4), a side wall 28 extending about the entire periphery of the base wall 26 and projecting perpendicularly thereto. The space between the inner surface of the base wall 26 and the inner surface of the side wall 28 defines a hollow interior cavity 30. The top of the cavity 30, i.e., the area bounded by the top surface of the side wall 28, is open at 32 and in communication with the cavity 30. The cavity 30 serves as the receptacle for the wallet 10 and any other items to be held within it after the wallet has been removed. In the exemplary embodiment shown the base wall 26 is of rectangular shape having four linear side edges 26A, 26B, 26C and 26D. The peripheral side wall 28 includes four generally planar sections 28A, 28B, 28C and 28D extending along the linear side edges, 26A, 26B, 26C and 26D, respectively, of the base wall 26.

The housing 24 is somewhat similar in construction to the tray 22 and basically comprises a generally planar base wall 34 and a side wall 36 projecting perpendicularly thereto. The exemplary embodiment of the base wall 34 is of rectangular shape that is just slightly larger than the base wall 26 of the tray 22 and includes four linear side edges 34A, 34B, 34C and 34D. Unlike the tray 22, the side wall 36 of the housing extends about only a portion of the periphery of its base wall 34. Thus, the side wall 36 of the housing 24 includes only three sections 36A, 36B and 36D, which extend along and project perpendicularly to the side edges 34A, 34B and 34D, respectively, of the base wall 34. The remaining side edge 34D of the base wall 34 does not include any side wall section, i.e., there is a gap 38 in the side wall 36 along that edge. The volume bounded by the interior surfaces of the sections 36A, 36B and 36C of the side wall 36 and the inner surface of the base wall 34 defines a hollow interior cavity 40 in communication with the gap 38. This gap 38 serves as the entrance to slide the tray 22 into and out of the housing 24. The top of the cavity 40, i.e., the area bounded by the top surface of the side wall 36, is open at 42 and is in communication with the cavity 40.

The cavity 40 of the housing 24 serves as the receptacle for the tray 22. To that end the tray is inserted into the cavity 40 of the housing by sliding it through the gap 38 in the side wall 36 like shown in FIG. 2. When the tray is oriented so that its open top faces away from the base wall of the housing, such as shown in FIGS. 1 and 2, the package 20 can serve as a display box for the wallet. If it is desired to dispose the package on a prong 12 or other horizontally projecting member of a conventional display rack (not shown), the package 20 may include a releasably securable hanger 44. One exemplary hanger is the hang tag 44 shown in FIG. 1. That tag basically comprises a flat strip or web of any suitable material, e.g., plastic. The strip includes a releasably securable adhesive, not shown, on one portion of its surface for releasable securement to the back surface of the base wall 34 of the housing 24 adjacent the peripheral wall section 36A. The strip 44 also includes an opening 46 which is arranged to receive the prong or hanger 12 of the display rack (not shown) so that the package 20 can be suspended as shown in FIG. 1.

As mentioned earlier the package 20 includes a magnetic assembly to prevent the tray from accidentally falling out of the housing, particularly, when the package is suspended from a prong as shown in FIG. 1 or when held in any similar orientation. The magnetic assembly 48 basically comprises a pair of magnets 50 and 52. The magnet 50 is embedded centered within the section 36A of the peripheral side wall 36 of the housing 24, while a similar magnet 52 is embedded centered within the section 28 of the side wall 28 of the tray 22. In the embodiment shown the two magnets are each shown as being disk-like members. That is merely exemplary of a myriad of shapes and sizes for the magnets 50 and 52. In fact, both of those components need not be magnets. Thus, for example, one of the components 50 or 52 can be a magnet, while the other is merely a ferromagnetic material. The components 50 and 52 are preferably embedded in their respective side wall sections to render them invisible in the interest of aesthetics.

The tray and housing are preferably formed of any relatively inexpensive, rigid material, e.g., paperboard, plastic, wood, metal or combinations thereof, with the type of material used being a function of the desired cost for producing the package. For low cost applications the tray and housing may be formed of paperboard or similar low cost materials and having a film or other covering thereon which bears graphics and/or textures to simulate higher cost materials, e.g., a fine wood or metal.

It should be pointed out at this juncture that the shape, size and construction of the housing and tray as shown and described above is merely exemplary of numerous shapes and sizes of packages that can be made in accordance with this invention. Moreover, while the package has been shown and described for merchandising a wallet or billfold, that is merely one example of various products that can be merchandised using such packages. Further still, the packages of this invention may be used with other types of hangers than the hang tag described above. In fact, the package need not be used with any device for hanging it. Thus, it can be used by merely disposing it on some support surface, e.g., on a shelf of a rack or counter, etc.

While the invention has been described in detail and with reference to specific examples thereof, it will be apparent to one skilled in the art that various changes and modifications can be made therein without departing from the spirit and scope thereof.

What is claimed is:

1. A convertible display package for an article, said package being arranged to be displayed on a support structure and comprising a tray and a housing, said tray being a box-like member having a base wall, a side wall extending about the periphery of said base wall, an open top and a hollow interior defined between said base wall and said side wall and in communication with said open top, said hollow interior of said tray being arranged for receipt of the article therein, said housing having a base wall, a side wall extending about a portion of the periphery of said base wall of said housing, an open top and a hollow interior defined between said base wall of said housing and said side wall of said housing and in communication with said open top of said housing, said side wall of said housing having a gap therein in communication with said hollow interior of said housing and said open top of said housing, said tray being arranged to be located within said hollow interior of said housing, with said side wall of said tray being located adjacent said side wall of said housing and with said open top of said tray being located within said open top of said housing so that the article is visible therethrough, said tray being arranged to be slid out of said housing through said gap, said package additionally comprising a magnetic closure assembly for releasably holding said tray within said hollow interior of said housing, said housing being adapted to be reversibly oriented with respect to said tray to form a lid for said tray, with said tray located within said hollow interior of said housing and with said base wall of said housing closing said open top of said tray, whereupon said hollow interior of said tray is totally enclosed.

2. The display package of claim 1 wherein said magnetic closure assembly comprises a magnetic element and a cooperating element, said magnetic element comprising a magnet located in a portion of the side wall of either said tray or said housing, said cooperating element being located in a corresponding portion of the side wall of the other of said tray or said housing.

3. The display package of claim 2 wherein said cooperating element also comprises a magnet.

4. The display package of claim 2 wherein said magnetic element and said cooperating element are disposed within said side walls so as not to be visible.

5. The display package of claim 1 additionally comprising a hanger releasably secured to said lid for hanging said display package from the support structure.

6. The display package of claim 5 wherein said hanger is releasably adhesively secured to said housing.

7. The display package of claim 1 wherein said tray and said housing each include visible surface portions providing the appearance of a decorative finish.

8. In combination a display package and a wallet, said package being arranged to displayed on a support structure and comprising a tray and a housing, said tray being a box-like member having a base wall, a side wall extending about the periphery of said base wall, an open top and a hollow interior defined between said base wall and said side wall and in communication with said open top, said wallet being located within said hollow interior of said tray, said housing having a base wall, a side wall extending about a portion of the periphery of said base wall of said housing, an open top and a hollow interior defined between said base wall of said housing and said side wall of said housing and in communication with said open top of said housing, said side wall of said housing having a gap therein in communication with said hollow interior of said housing and said open top of said housing, said tray being arranged to be located within said hollow interior of said housing, with said side wall of said tray being located adjacent said side wall of said housing and with said open top of said tray being located within said open top of said housing so that said wallet is visible therethrough, said tray being arranged to be slid out of said housing through said gap, said package additionally comprising a magnetic closure assembly for releasably holding said tray within said hollow interior of said housing, said housing being adapted to be reversibly oriented with respect to said tray to form a lid for said tray, with said tray located within said hollow interior of said housing and with said base wall of said housing closing said open top of said tray, whereupon said hollow interior of said tray is totally enclosed.

9. The combination of claim 8 wherein said magnetic closure package comprises a magnetic element and a cooperating element, said magnetic element comprising a magnet located in a portion of the side wall of either said tray or said housing, said cooperating element being located in a corresponding portion of the side wall of the other of said tray or said housing.

10. The combination of claim 9 wherein said cooperating element also comprises a magnet.

11. The combination of claim 9 wherein said magnetic element and said cooperating element are disposed within said side walls so as not to be visible.

12. The combination of claim 8 additionally comprising a hanger releasably secured to said housing for hanging said combination of from the support structure.

13. The combination of claim 12 wherein said hanger is releasably adhesively secured to said housing.

14. The combination of claim 8 wherein said tray and said housing include visible surface portions providing the appearance of a decorative finish.

* * * * *